US012350579B2

(12) United States Patent
Shigeta

(10) Patent No.: US 12,350,579 B2
(45) Date of Patent: Jul. 8, 2025

(54) CARD SHOOTER DEVICE AND METHOD

(71) Applicant: ANGEL GROUP CO., LTD., Shiga (JP)

(72) Inventor: Yasushi Shigeta, Shiga (JP)

(73) Assignee: ANGEL GROUP CO., LTD., Shiga (JP)

( * ) Notice: Subject to any disclaimer, the term of this patent is extended or adjusted under 35 U.S.C. 154(b) by 0 days.

(21) Appl. No.: 17/994,619

(22) Filed: Nov. 28, 2022

(65) Prior Publication Data

US 2023/0087190 A1 Mar. 23, 2023

Related U.S. Application Data

(63) Continuation of application No. 16/730,176, filed on Dec. 30, 2019, now abandoned, which is a (Continued)

(51) Int. Cl.

| | |
|---|---|
| ***A63F 1/14*** | (2006.01) |
| ***A63F 1/18*** | (2006.01) |
| *A63F 9/24* | (2006.01) |

(52) U.S. Cl.

CPC ..... *A63F 1/14* (2013.01); *A63F 1/18* (2013.01); *A63F 2009/2419* (2013.01); *A63F 2250/58* (2013.01)

(58) Field of Classification Search

CPC ..... A63F 1/14; A63F 1/18; A63F 2250/58; A63F 2009/2419; A63F 2009/2451; A63F 2009/2457

See application file for complete search history.

(56) References Cited

U.S. PATENT DOCUMENTS

| | | | |
|---|---|---|---|
| 4,513,696 | A | 4/1985 | Fujii et al. |
| 4,513,969 | A | 4/1985 | Samsel, Jr. |

(Continued)

FOREIGN PATENT DOCUMENTS

| | | | |
|---|---|---|---|
| AU | 2013203307 | B2 | 4/2014 |
| AU | 2015202960 | A1 | 6/2015 |

(Continued)

OTHER PUBLICATIONS

Australian Patent Examination Report No. 1, Australian Patent Application No. 2013203307, mailed Oct. 15, 2014.

(Continued)

*Primary Examiner* — John E Simms, Jr.

(74) *Attorney, Agent, or Firm* — NORTON ROSE FULBRIGHT US LLP

(57) ABSTRACT

A card shoe apparatus including a card housing unit for housing a plurality of cards; an opening in the card housing unit for manually withdrawing the cards one by one from the card housing unit in a card reading direction; a card reading unit that reads information on the cards as the cards are manually withdrawn from the card housing unit in the card reading direction; a control unit that stores rules of a card game and determines the results of the card game based on the information read by the card reading unit and the rules of the card game; an optical device that detects movements of the cards relative to the card reading direction; and a card entry/exit restriction unit provided in the opening. The card entry/exit restriction unit restricts the entry or exit of any of the cards when the cards are improperly withdrawn from the opening.

6 Claims, 5 Drawing Sheets

Related U.S. Application Data continuation of application No. 15/465,444, filed on Mar. 21, 2017, now Pat. No. 10,549,178, which is a continuation of application No. 14/621,099, filed on Feb. 12, 2015, now Pat. No. 9,649,550, which is a continuation of application No. 14/419,605, filed as application No. PCT/JP2012/006230 on Sep. 28, 2012, now Pat. No. 10,343,055.

(56) References Cited

U.S. PATENT DOCUMENTS 4,534,562 A 8/1985 Cuff et al.
4,586,712 A 5/1986 Lorber et al.
4,794,239 A 12/1988 Allais
5,067,713 A 11/1991 Soules et al.
5,166,502 A 11/1992 Rendleman et al.
5,169,155 A * 12/1992 Soules ..... A63F 1/14 283/88
5,259,907 A * 11/1993 Soules ..... A63F 1/14 283/79
5,331,141 A 7/1994 Kaneko
5,374,061 A 12/1994 Albrecht
5,669,813 A 9/1997 Jairazbhoy et al.
5,669,816 A 9/1997 Garczynski et al.
5,707,287 A 1/1998 McCrea, Jr.
5,722,893 A 3/1998 Hill et al.
5,779,546 A 7/1998 Meissner
5,814,804 A 9/1998 Kostizak
5,911,626 A 6/1999 McCrea, Jr.
5,941,769 A 8/1999 Order
5,989,122 A 11/1999 Roblejo
6,039,650 A 3/2000 Hill
6,042,150 A 3/2000 Daley
6,066,857 A 5/2000 Fantone et al.
6,093,103 A 7/2000 McCrea, Jr.
6,098,892 A 8/2000 Peoples, Jr.
6,126,166 A 10/2000 Lorson et al.
6,217,447 B1 4/2001 Lofink et al.
6,270,406 B1 8/2001 Sultan
6,460,848 B1 10/2002 Soltys et al.
6,527,191 B1 3/2003 Jannersten
6,582,301 B2 6/2003 Hill
6,588,751 B1 7/2003 Grauzer et al.
6,629,894 B1 10/2003 Purton
6,637,622 B1 10/2003 Robinson
6,638,161 B2 10/2003 Soltys et al.
7,029,009 B2 4/2006 Grauzer et al.
7,093,130 B1 8/2006 Kobayashi et al.
7,172,507 B2 2/2007 Fujimoto et al.
7,222,852 B2 5/2007 Soltys et al.
7,422,522 B2 9/2008 Fujimoto et al.
7,762,468 B2 7/2010 Jones et al.
7,762,889 B2 7/2010 Shigeta
7,946,586 B2 5/2011 Krenn et al.
7,950,663 B2 5/2011 Schubert
7,967,672 B2 6/2011 Shigeta
8,221,244 B2 7/2012 French
8,309,163 B2 11/2012 Van Duren
8,556,262 B2 10/2013 Shigeta
8,590,896 B2 11/2013 Krenn et al.
8,801,516 B2 8/2014 Shigeta
10,343,055 B2 * 7/2019 Shigeta ..... A63F 1/14
2002/0017481 A1 2/2002 Johnson et al.
2002/0063389 A1 5/2002 Breeding et al.
2002/0068635 A1 * 6/2002 Hill ..... A63F 1/14 463/47
2002/0155869 A1 10/2002 Soltys et al.
2002/0163125 A1 11/2002 Grauzer
2002/0165029 A1 11/2002 Soltys et al.
2003/0003997 A1 1/2003 Vuong et al.
2003/0171142 A1 9/2003 Kaji et al.
2003/0176209 A1 9/2003 Soltys et al.
2003/0195025 A1 10/2003 Hill
2004/0026636 A1 * 2/2004 Shigeta ..... B07C 5/3422 250/556
2004/0100026 A1 5/2004 Haggard
2004/0259618 A1 12/2004 Soltys et al.
2005/0012270 A1 1/2005 Schubert et al.
2005/0051955 A1 3/2005 Schubert et al.
2005/0062226 A1 3/2005 Schubert et al.
2005/0062227 A1 3/2005 Grauzer et al.
2005/0104290 A1 5/2005 Grauzer et al.
2005/0110210 A1 5/2005 Soltys et al.
2005/0121852 A1 6/2005 Soltys et al.
2005/0137005 A1 6/2005 Soltys et al.
2006/0063577 A1 3/2006 Downs, III et al.
2006/0247036 A1 11/2006 Shigeta
2006/0279040 A1 12/2006 Downs, III et al.
2007/0018389 A1 1/2007 Downs, III
2007/0216092 A1 9/2007 Fleckenstein
2007/0296151 A1 12/2007 Kyrychenko
2008/0006997 A1 1/2008 Scheper et al.
2008/0105750 A1 5/2008 Shigeta
2008/0111300 A1 5/2008 Czyzewski et al.
2008/0143048 A1 * 6/2008 Shigeta ..... A63F 1/18 273/149 R
2008/0224394 A1 * 9/2008 Shigeta ..... A63F 1/14 273/148 R
2009/0066021 A1 3/2009 Shigeta
2009/0134575 A1 5/2009 Dickinson et al.
2009/0140492 A1 6/2009 Yoseloff et al.
2009/0224476 A1 9/2009 Grauzer et al.
2009/0286597 A1 * 11/2009 Shigeta ..... A63F 1/14 235/494
2010/0133754 A1 6/2010 Shigeta
2010/0213667 A1 6/2010 Grauzer et al.
2010/0276887 A1 11/2010 Yoshida
2010/0289214 A1 11/2010 Just
2010/0327525 A1 12/2010 Shigeta
2011/0034243 A1 2/2011 Shigeta
2011/0130185 A1 6/2011 Walker
2011/0148038 A1 6/2011 Laughlin
2011/0198805 A1 8/2011 Downs, III et al.
2011/0210175 A1 9/2011 Shigeta
2011/0275432 A1 11/2011 Lutnick et al.
2012/0091656 A1 4/2012 Blaha et al.
2012/0306152 A1 * 12/2012 Krishnamurty ..... A63F 1/18 273/149 R
2013/0207344 A1 8/2013 Shigeta
2013/0303277 A1 11/2013 Shigeta
2014/0042697 A1 * 2/2014 Berube ..... A63F 1/14 273/149 R
2014/0291930 A1 * 10/2014 Berube ..... A63F 1/14 273/149 R
2015/0014925 A1 1/2015 Miller et al.
2015/0069699 A1 3/2015 Blazevic
2015/0238849 A1 8/2015 Grauzer et al.
2015/0375095 A1 12/2015 Shigeta
2017/0173447 A1 * 6/2017 Martino ..... A63F 1/10

FOREIGN PATENT DOCUMENTS

CN 1525874 A 9/2004
CN 2772570 Y 4/2006
CN 1933881 A 3/2007
CN 101099896 A 1/2008
CN 101437586 A 5/2009
CN 101484216 A 7/2009
CN 101541388 A 9/2009
CN 101588847 A 11/2009
CN 101678232 A 3/2010
CN 101711177 A 5/2010
CN 101884840 A 11/2010
CN 101920104 A 12/2010
CN 101972544 A 2/2011
CN 102307633 A 1/2012
CN 202398088 U 8/2012
GB 2380143 A1 4/2003
JP H5-398 1/1993
JP H5-20512 1/1993
JP H9-144353 6/1997
JP H9-215812 8/1997
JP H10508236 A 8/1998

(56) References Cited

FOREIGN PATENT DOCUMENTS

| | | | |
|---|---|---|---|
| JP | 2000327255 | | 11/2000 |
| JP | 2001222687 | | 8/2001 |
| JP | 2002165916 | | 6/2002 |
| JP | 2002224443 | | 8/2002 |
| JP | 2002282413 | | 10/2002 |
| JP | 2003052902 | | 2/2003 |
| JP | 2003070956 | | 3/2003 |
| JP | 2003144742 | | 5/2003 |
| JP | 2003250950 | | 9/2003 |
| JP | 2004215806 | A | 8/2004 |
| JP | 2005198668 | | 7/2005 |
| JP | 2005267625 | | 9/2005 |
| JP | 2005296634 | A | 10/2005 |
| JP | 2007236995 | | 9/2007 |
| JP | 2008161479 | A | 7/2008 |
| JP | 2008188471 | | 8/2008 |
| JP | 2009213520 | A | 9/2009 |
| WO | 199614115 | | 5/1996 |
| WO | 199943404 | | 9/1999 |
| WO | 2001056670 | | 8/2001 |
| WO | 0205914 | A1 | 1/2002 |
| WO | 2002064225 | | 8/2002 |
| WO | 02094397 | A1 | 11/2002 |
| WO | 2003026763 | | 4/2003 |
| WO | 2003078006 | A2 | 9/2003 |
| WO | 2009069708 | A1 | 6/2009 |
| WO | 2010019708 | A1 | 2/2010 |
| WO | 2010055328 | A1 | 5/2010 |
| WO | 2010056562 | A1 | 5/2010 |
| WO | 20110052573 | A2 | 5/2011 |
| WO | 2012035742 | A1 | 3/2012 |
| WO | 2012053179 | A1 | 4/2012 |
| WO | 2012166197 | A1 | 12/2012 |
| WO | 2013116297 | A1 | 8/2013 |
| WO | 2014049946 | | 4/2014 |

OTHER PUBLICATIONS

Australian Patent Examination Report No. 1, Australian Patent Application No. 2013203316, mailed Dec. 10, 2014.
International Search Report, International Application No. PCT/JP2013/004956, mailed Sep. 24, 2013.
Australian Examiner's First Report, Australian Patent Application No. 2008200596, mailed Nov. 6, 2009.
Australian Examiner's Report No. 2, Australian Patent Application No. 2010235931, mailed Jul. 11, 2011.
International Preliminary Report on Patentability, International Application No. PCT/JP2005/003789, mailed Feb. 2, 2006.
International Search Report, International Application No. PCT/JP2005/003789, mailed Apr. 26, 2005.
Final Office Action, U.S. Appl. No. 10/542,073, mailed Apr. 14, 2010.
Non-Final Office Action, U.S. Appl. No. 11/884,021, mailed Dec. 8, 2010.
Non-Final Office Action, U.S. Appl. No. 11/929,727, mailed Oct. 1, 2010.
Non-Final Office Action, U.S. Appl. No. 11/929,727, mailed Mar. 7, 2011.
Non-Final Office Action, U.S. Appl. No. 12/231,657, mailed Mar. 19, 2010.
Final Office Action, U.S. Appl. No. 12/231,657, mailed Dec. 8, 2010.
Non-Final Office Action, U.S. Appl. No. 12/825,261, mailed Nov. 23, 2010.
New Zealand First Examination Report, NZ Patent Application No. 704620, mailed Jul. 31, 2015.
Chinese First Office Action, Chinese Patent Application No. 201310225940.6, mailed Dec. 3, 2015.
New Zealand First Examination Report, NZ Patent Application No. 706311 mailed Dec. 8, 2015.
Korean Office Action, Korean Patent Application No. 10-2015-7007553, mailed Mar. 28, 2016.
New Zealand First Examination Report, NZ Patent Application No. 716059, mailed May 6, 2016.
Australian Examination Report No. 1, Australian Patent Application No. 2015202960, mailed Jun. 9, 2016.
Korean Notice of Allowance, Korean Patent Application No. 10-2015-7007316, mailed Jun. 16, 2016.
Chinese Notice of Allowance, Chinese Patent Application No. 201310220992.4, mailed Jul. 4, 2016.
New Zealand First Examination Report, NZ Patent Application No. 720973, mailed Jul. 29, 2016.
International Search Report, European Patent Application No. 13842336.3, mailed Aug. 24, 2016.
Australian Examination Report, Australian Patent Application No. 2016262639, mailed Jan. 19, 2018.
Australian Office Action, Australian Patent Application No. 2016208351, mailed May 11, 2017.
Australian Examination Report No. 1, Australian Patent Application No. 2016208352, mailed May 11, 2017.
International Search Report, PCT Patent Application No. PCT/JP2005/003789, mailed Feb. 2, 2006.
International Search Report, PCT Patent Application No. PCT/JP2012/006230, mailed Nov. 13, 2012.
Written Opinion,PCT Application No. PCT/JP2013/004956, mailed Sep. 24, 2013.
Non-Final Office Action, U.S. Appl. No. 14/431,239, mailed Dec. 19, 2016.
Final Office Action, U.S. Appl. No. 14/431,239, mailed Sep. 6, 2017.
Non-Final Office Action, U.S. Appl. No. 14/431,239, mailed Jun. 8, 2018.
Non-Final Office Action, U.S. Appl. No. 15/456,322, mailed Jun. 4, 2018.
Chinese Notice of Allowance, CN Patent Application No. 201510315068.3, mailed Mar. 19, 2018.
Chinese First Office Action, Chinese Patent Application No. 201610830365.6, mailed Feb. 15, 2019.
New Zealand First Examination Report, NZ Patent Application No. 731453, mailed Dec. 4, 2017.
Japanese Office Action, JP Patent Application No. 2016-240958, mailed Aug. 29, 2017.
Australian Examination Report No. 1, AU Application No. 2017225160, mailed Aug. 3, 2018.
Australian Examination Report No. 2, AU Application No. 2016262639, mailed Jun. 17, 2018.
Australian Examination Report, AU Application No. 2016262639, mailed Jan. 19, 2018.
Korean Notice of Allowance, Korean Patent Application No. 10-2016-7025597, mailed Oct. 20, 2016.
Korean Notice of Allowance, Korean Patent Application No. 10-2015-7007553, mailed Mar. 28, 2016.
Chinese Office Action, Chinese Patent Application No. 201380049993.5, mailed Jan. 3, 2017.

* cited by examiner

CARD SHOOTER DEVICE AND METHOD

CROSS REFERENCE TO RELATED APPLICATIONS

This application is a continuation of U.S. patent application Ser. No. 16/730,176 filed Dec. 30, 2019, which is a continuation of U.S. patent application Ser. No. 15/465,444 filed Mar. 21, 2017 (now U.S. Pat. No. 10,549,178), which is a continuation of U.S. patent application Ser. No. 14/621,099 filed Feb. 12, 2015 (now U.S. Pat. No. 9,649,550), which is a continuation of U.S. patent application Ser. No. 14/419,605 filed Feb. 4, 2015 (now U.S. Pat. No. 10,343,055), which is a national phase application under 35 U.S.C. § 371 of International Application No. PCT/JP2012/006230 filed Sep. 28, 2012; each of the applications mentioned in this paragraph is incorporated herein by reference.

DESCRIPTION

Technical Field

The present invention relates to a card shoe apparatus having a function of preventing cheating in card games such as baccarat that are played using playing cards (hereinafter simply referred to as "cards") and a method.

Background Art

Conventional card shoe apparatuses that are suitable for use in card games played in casinos or the like have been proposed. For example, a card shoe apparatus is disclosed in JP 1998-508236A. In the card shoe apparatus of JP 1998-508236A, a CCD image sensor and the related optical system components are incorporated in the card shoe. Also, a card reading window is provided in the exit of the card shoe. When a card passes through the exit of the shoe, the suit (type) and the rank (number) of the card are read through the card reading window (see, JP 1998-508236A at page 12, FIG. 1).

SUMMARY OF INVENTION

However, such a conventional apparatus could not prevent a fraudulent act such as the insertion of false cards from the exit of the card shoe.

The present invention has been made in view of the above problem, and aims to provide a card shoe and a method with which it is possible to prevent the fraudulent insertion of cards into a card shoe used in the card game or the fraudulent dealing of cards, as well as the dealing of any card that should not be dealt onto the game table.

To solve the above conventional problems, the present invention provides a card shoe apparatus including: a card housing unit for housing a plurality of cards; an opening unit for manually taking out cards one by one from the card housing unit; a card reading unit that reads information of a card that is manually drawn out from the card housing unit onto a game table from that card; a control unit that stores rules of a card game and determines the winning/losing of the card game according to the rules of the card game based on the information of a card read by the card reading unit; a display unit that outputs a winning/losing result as determined by the control unit; and a card entry/exit restriction unit that is provided in the opening unit and restricts the entry/exit of a card from the card housing unit, the card housing unit, the card reading unit, the control unit, the display unit and the card entry/exit restriction unit being configured as a single unit, wherein the card entry/exit restriction unit includes: 1) a function of prohibiting the insertion of a card that is inserted from the exterior toward the card housing unit via the opening unit in an opposite direction; and 2) a function of prohibiting, based on the information of a card read by the card reading unit, the drawing out of any additional card in a case where no additional card needs to be drawn out from the card housing unit.

With the present invention, it is possible to provide a card shoe apparatus and a method capable of preventing, on site, any fraudulent act such as the fraudulent insertion of cards into a card shoe apparatus, false or inappropriate dealing of cards or the like.

DESCRIPTION OF EMBODIMENTS

Figure 1:
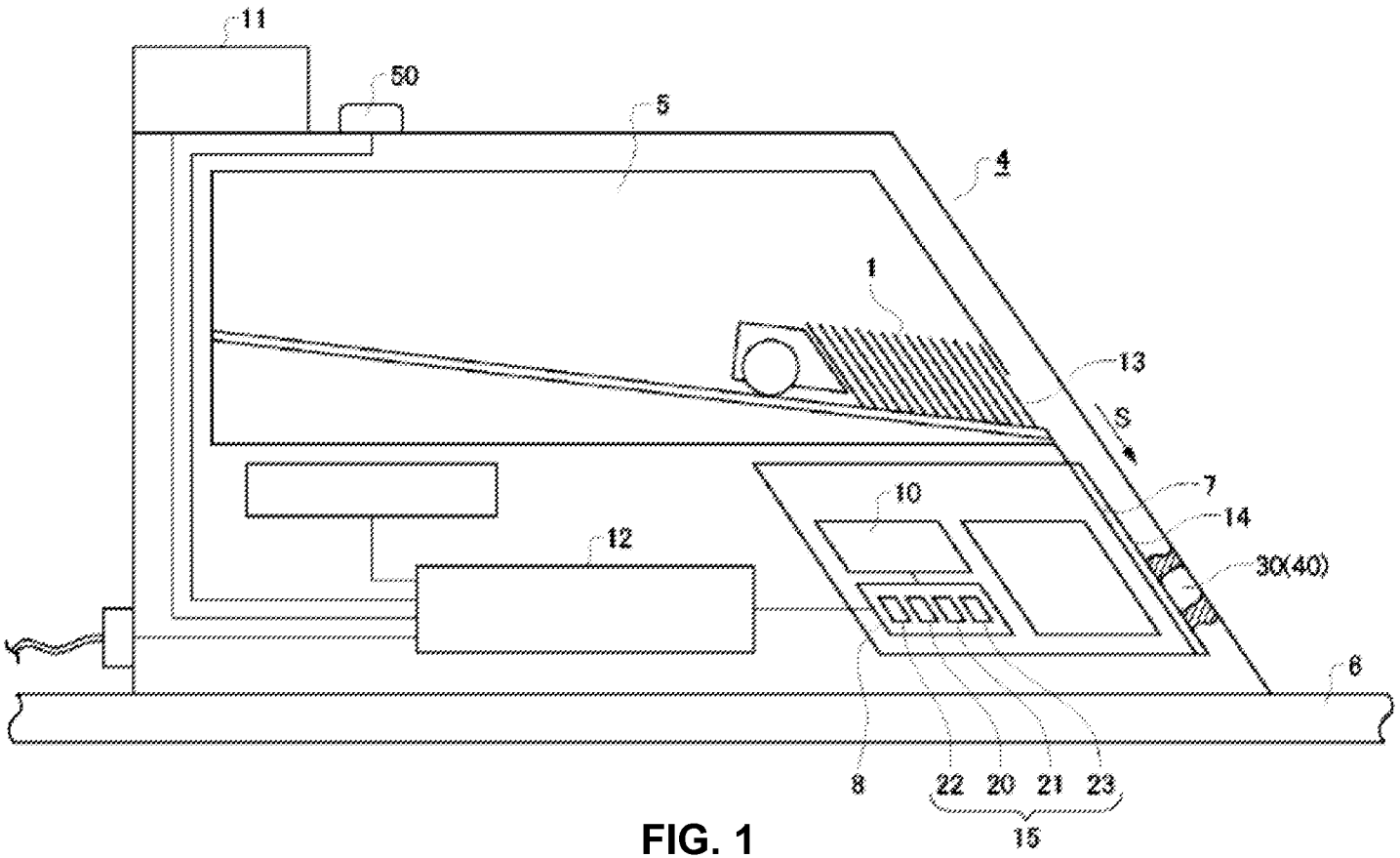
FIG. 1 is a block diagram illustrating the entirety of a card shoe apparatus according to an embodiment of the present invention.
Figure 2:
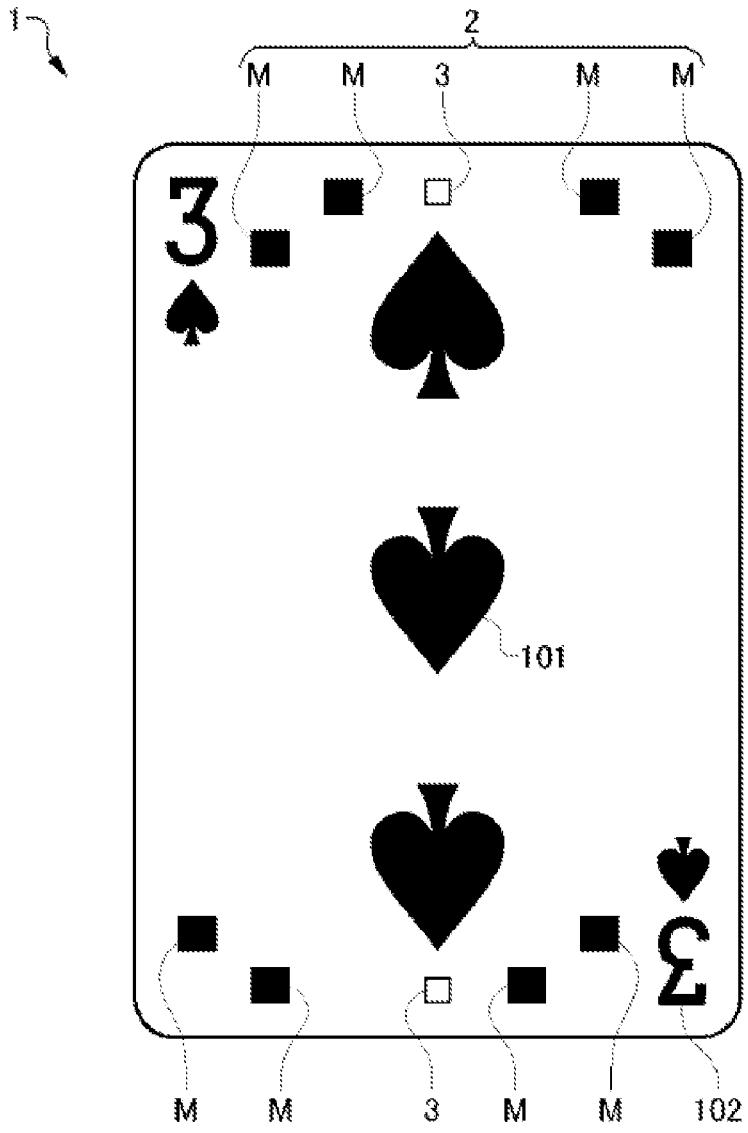
FIG. 2 shows an example of a card according to the embodiment of the present invention.

An embodiment of a table game system of the present invention will be described below in detail. FIG. 1 is a block diagram illustrating the entirety of a card shoe apparatus to be used in a table game system of the present embodiment. FIG. 2 illustrates a card 1 used in the table game system of the present embodiment. In the card 1 used in table games such as baccarat, a code 2 by which is composed of marks M that are invisible in a normal condition is provided in the upper side and the lower side of the card 1 in a point-symmetric manner. A rank (number, rank) of that card 1 is coded by the code 2. Also, the card 1 includes an authenticity determination code 3, which is created by coding information that indicates the authenticity of the card, and is arranged by printing or the like so as to be invisible in a normal condition (for example, in ultraviolet reactive ink).

In FIG. 1, a card shoe apparatus 4 includes a card guide unit 7 that guides cards 1 that are manually drawn out one by one from a card housing unit 5 onto a game table 6, a code reading unit 8 that reads, when a card 1 is manually drawn out from the card housing unit 5 by a dealer or the like of a casino, the code 2 that indicates a rank (number, rank) of that card 1, a winning/losing determination unit 10 that determines the winning/losing of the card game based on the ranks of the cards 1 sequentially read by the code reading unit 8, and an output unit 11 that outputs the result of the determination made by the winning/losing determination unit 10. The card guide unit 7 includes a card entry/exit restriction unit 30 or 40 (to be described later) that restricts the entry/exit of the card 1 from the card housing unit 5.

Figure 3:
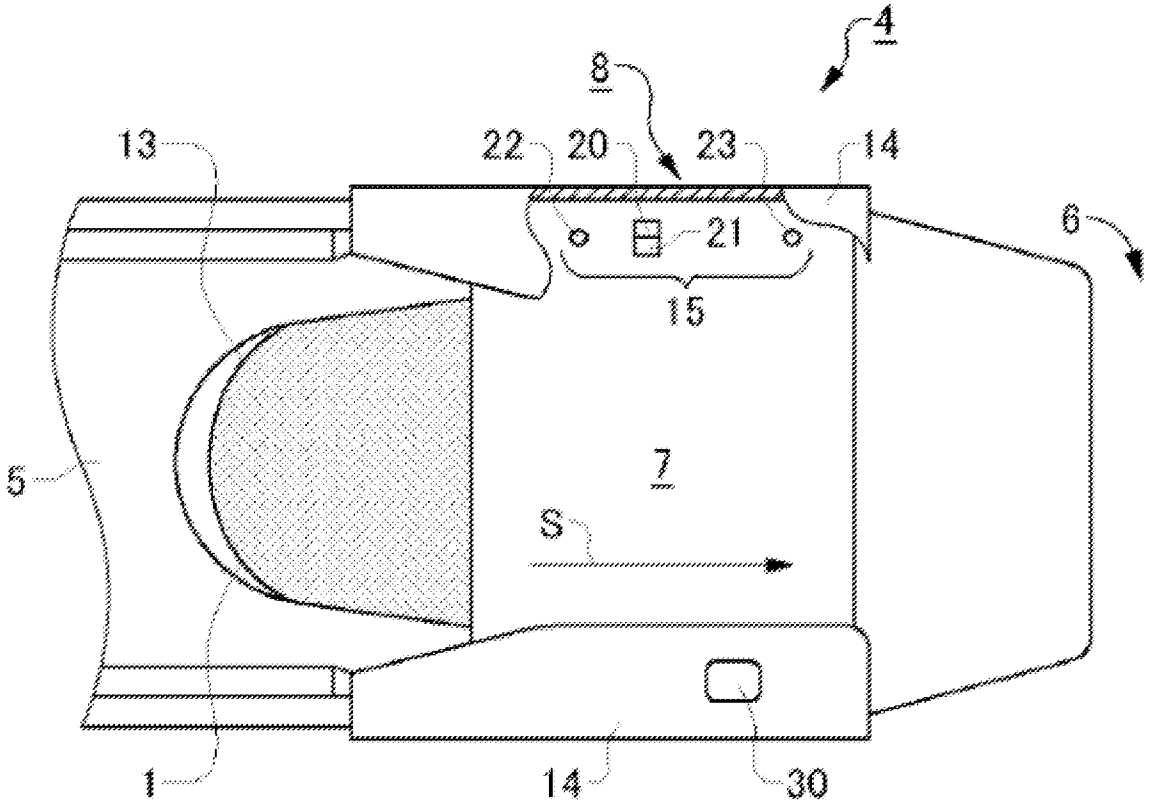
FIG. 3 is a plan view of a main portion of a card guide of the card shoe apparatus according to an embodiment of the present invention, with the card guide partially broken.

Next, the code reading unit 8 that reads, from a card 1, the code 2 that indicates a rank (number, rank) of the card 1 when the card 1 is manually drawn out from the card housing unit 5 will be described in detail with reference to FIG. 3. FIG. 3 is a plan view of a main portion of the card shoe apparatus 4. In FIG. 3, the code reading unit 8 is provided in the card guide unit 7 that guides the cards 1 manually taken out one by one from an opening 13 onto the game table 6, with the opening 13 provided in a front portion of the card housing unit 5. The card guide unit 7 is an inclined surface, and a card guide 14 is attached to an edge portion of each of both sides thereof, with the card guide 14 also serving as a sensor cover. Also, two card guides 14 are each configured to be attachable/detachable with screws or the like (not shown). When a card guide 14 is removed, a sensor group 15 of the code reading unit 8 is exposed. The sensor group 15 is composed of four sensors, including two ultraviolet reactive sensors (UV sensors) 20 and 21, and object detection sensors 22 and 23.

The object detection sensors 22 and 23 are optical fiber sensors that each detect the presence of the card 1, and are capable of detecting movement of the card 1. The object detection sensor 22 is placed in the upstream side of the card guide unit 7 with respect to the travel direction of the card 1, and the object detection sensor 23 is placed in the downstream side of the card guide unit 7 with respect to the travel direction of the card 1. As shown in FIG. 3, the object detection sensors 22 and 23 are respectively provided in the upstream side and the downstream side of the UV sensors 20 and 21. The UV sensors 20 and 21 each include an LED (UV LED) that emits an ultraviolet ray and a detector. The marks M of the code 2 are printed on the card 1 in UV luminescent ink that emits color when UV ray is applied. The card 1 is irradiated with the UV ray (black light), and the detector detects the light reflected by the marks M of the code 2 of the card 1. The UV sensors 20 and 21 are connected to a control apparatus 12 of the code reading unit 8 via a cable. In the code reading unit 8, the arrangement patterns of the marks M are determined based on the output signals from the detectors of the UV sensors 20 and 21, such that the number (rank) corresponding to the code 2 is determined.

In the code reading unit 8, the start and end of the reading performed by the UV sensors 20 and 21 are controlled by the control apparatus 12 based on the detection signals from the object detection sensors 22 and 23. Also, the control apparatus 12 determines whether the card 1 has normally passed through the card guide unit 7 based on the detection signals from the object detection sensors 22 and 23. As shown in FIG. 2, the rectangular marks M are arranged within a framework of two rows with four columns on each of the upper and bottom edges of a card, and the arrangement of such marks indicates the rank (number) and the suit (Heart, Spade or the like) of the card. When the UV sensor(s) 20 and/or 21 detect(s) a mark M, such UV sensor(s) output(s) an on signal. The code reading unit 8 determines the relative relation between the signals received from the two UV sensors 20 and 21. In this way, the code reading unit 8 identifies the code based on the relative difference or the like between the two marks M detected by the two UV sensors 20 and 21, thereby identifying the number (rank) and the type (suit) of the corresponding card 1.

Figure 5:
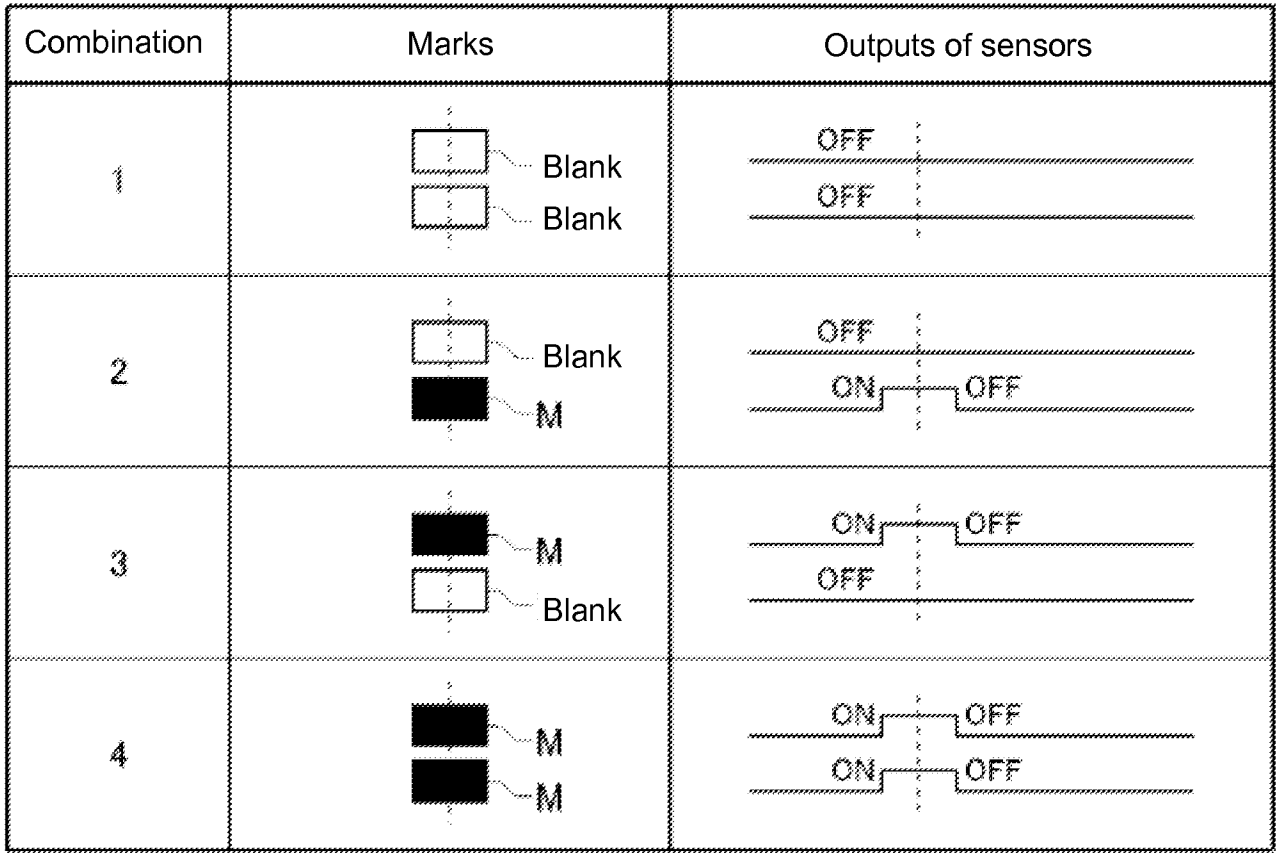
FIG. 5 is a diagram illustrating the relation between output waves from sensors and marks with the card shoe apparatus according to an embodiment of the present invention.

The relation between the code 2 and the output of the on signals from the two UV sensors 20 and 21 are shown in FIG. 5. It is possible to identify a predetermined arrangement pattern of the marks M based on the comparison results of the relative changes in the output of the on signals from the UV sensors 20 and 21. As a result, in two rows (the upper and lower rows), four types of arrangement patterns of the mark M are possible, and since patterns are printed in four columns, it is possible to form 256 types of codes (4×4×4×4). Fifty two (52) playing cards are each assigned to one of the 256 codes, and the relations of such assignment are stored in a memory or by a program as an association table. A configuration is thereby adopted in which the card reading unit 8 can, by identifying the code 2, identify the number (rank) and the type (suit) of the card 1 based on that predetermined association table (not shown). Also, 52 cards can be freely associated with 52 codes out of the 256 codes to be stored in the association table, and thus, there will be a variety of associations between them. Therefore, it is possible to change the associations between the 256 codes and 52 cards depending on the time or place. Preferably, the code is printed with a paint material that becomes visible when irradiated with UV ray, and placed in a position where it does not overlap the indications of the card types or indexes 102.

Next, the configuration of the control apparatus 12 will be described. The control apparatus 12, the code reading unit 8, the winning/losing determination unit 10 and the like are realized by a computer apparatus. For example, the function of automatically determining the winning/losing of a game (the winning/losing determination unit 10) is realized by installing a program for determining the winning/losing in a computer, and that program is executed by a processor of the computer. The ranks of cards sequentially taken out onto the game table 6 are acquired using the UV sensors 20 and 21 in the code reading unit 8, and the ranks of cards thus acquired are sequentially stored in a memory. At this time, information on which card 1 is dealt to which player is also stored. The number of each card is stored in association with the player to whom that card was dealt. In baccarat, there is a player and a banker. The rank (number) of the card dealt is stored in the memory in association with the player to whom it was dealt, and the ranks (number) of the cards dealt are added for each player, and the winner is determined based on the programmed rules. A "tie" is also judged.

Figure 4A:
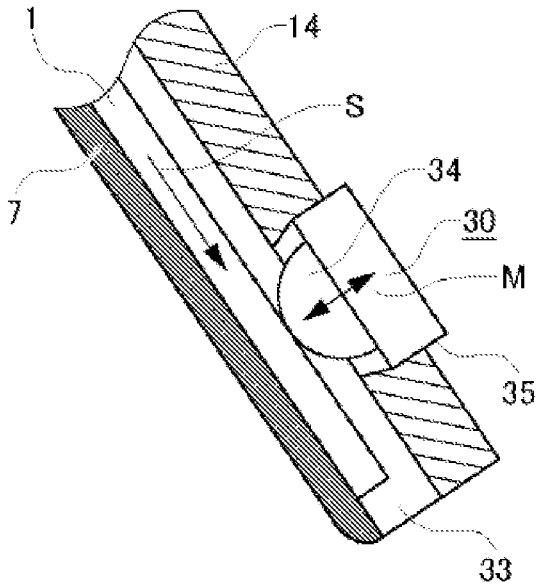
FIG. 4A is a cross-sectional view illustrating a main portion of a card entry/exit restriction unit that restricts the entry/exit of cards from a card housing unit of the card shoe apparatus according to an embodiment of the present invention as viewed from the side.

Next, the card entry/exit restriction unit 30 that restricts the entry/exit of the card 1 to/from the card housing unit 5 will be described with reference to FIG. 4. In FIG. 4A, the card entry/exit restriction unit 30 is provided in the card guide 14 of the card guide unit 7 that guides the cards 1 taken out one by one from the opening 13, which is provided in a front portion of the card housing unit 5, onto the game table 6. The card entry/exit restriction unit 30 has a structure by which when a card 1 passes through a slot 33 between the card guide unit 7 and the guide cover of the card guide 14, a lock member 34 presses the card 1 to prohibit the entry/exit of the card 1 within the slot 33. The lock member 34 is capable of moving in the direction indicated by the arrow M by a driving unit 35 composed of an electromagnetic solenoid, a piezoelectric device or the like, such that it can take two positions, namely, a position where the card 1 is pressed (restricted position) and a position where the card 1 is allowed to pass through. The driving unit 35 is controlled by the control apparatus 12, and causes the lock member 34 to move to two positions, namely, a position where the card 1 is pressed and a position where the card 1 is allowed to pass through. The rules of the baccarat game are programmed and stored in advance in the control apparatus 12.

Figure 4B:
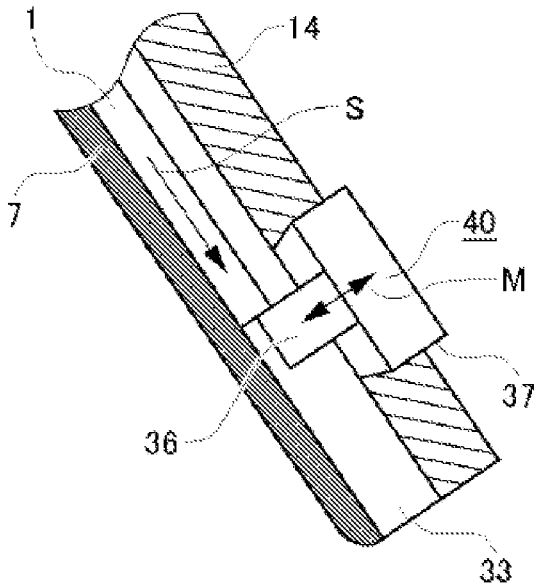
FIG. 4B is a cross-sectional view illustrating a main portion of a variation of the card entry/exit restriction unit that restricts the entry/exit of cards from a card housing unit of the card shoe apparatus according to an embodiment of the present invention as viewed from the side.

Next, a variation of the card entry/exit restriction unit 30 will be described with reference to FIG. 4B. A card entry/exit restriction unit 40 of the variation has a structure by which when a card 1 passes through the slot 33 between the card guide unit 7 and the guide cover of the card guide 14, a lock member 36 protrudes into the slot 33 to prohibit movement of the card 1. The lock member 36 is capable of moving in the direction indicated by the arrow M by a driving unit 37 composed of an electromagnetic solenoid, a piezoelectric device or the like, such that it can take two positions, namely, a position where movement of the card 1 is prohibited (restricted position) and a position where the card 1 is allowed to pass through. The driving unit 37 is controlled by the control apparatus 12, and causes the lock member 36 to move to two positions, namely, a position where movement of the card 1 is prohibited and a position where the card 1 is allowed to pass through.

The card entry/exit restriction unit 30 (40) is caused to function as a result of the driving unit 35 or 37 being controlled by the program of the control apparatus 12 to prevent the fraudulent entry/exit of the card 1. The card entry/exit restriction unit 30 (40) is provided with the object detection sensors 22 and 23 as sensors for detecting movement of the card 1, and has a function of detecting movement of the card 1 with these sensors 22 and 23 to restrict such movement. The details of the control (programmed control) performed for preventing the fraudulent entry/exit of the card 1 includes at least the following 1) and 2):

1) A function of prohibiting the insertion of a card 1 that is inserted in the direction opposite to the direction of the arrow S, namely, from the exterior toward the card housing unit 5 via the opening 13.

In this case, although the card 1 inserted for the purpose of cheating passes through the slot 33 between the card guide unit 7 and the card guide 14, the movement of the card 1 in a direction opposite to the normal direction (the direction opposite to the arrow S in FIG. 3) is detected based on the detection signals from the object detection sensors 22 and 23, and due to the program of the control apparatus 12, the driving units 35 or 37 will move their corresponding lock members 34 or 36 to their respective positions of pressing or blocking the card 1, respectively.

2) A function of prohibiting the drawing of a card 1 from the card housing unit 5 when such drawing should not be allowed based on the information on the suits and the ranks of the cards 1 read by a card reading unit (this means the code reading unit 8 that reads from a card 1 the code 2 that indicates a rank (number, rank) of that card 1 when the card 1 is drawn out from the card housing unit 5).

In this case, as described above, the rules of the baccarat game are programmed in advance in the control apparatus 12. In the baccarat game, whether each of the banker and the player should draw two or more cards 1 is uniquely determined according to the total of the ranks (numbers) of the two cards already dealt to each of them. Thus, if the dealer of a table attempts to deal a card 1 in a case where the third card should not be drawn, which is against the rules, movement of the card 1 is restricted. If drawing of the card 1 is attempted at a time or state when such drawing should not be allowed, movement of the card 1 is detected based on the signals of the detection of the card 1 given by the object detection sensor 22, and the driving units 35 or 37 will move their corresponding lock members 34 or 36 to their respective positions of pressing or blocking the card 1, respectively by the program of the control apparatus 12. In this manner, the lock members 34 or 36 will move to their respective positions of pressing or blocking the card 1, respectively, thereby prohibiting the dealing of additional cards 1 (the positions shown in FIG. 4). In this way, the attitude of dealing a card 1 by the dealer which is against the rules is detected, and the dealing of the card 1 is restricted, thus an apparatus that restricts the entry/exit of the card 1 gets used up more slowly than the case of blocking the card 1 at every end of the games.

An error signal output unit 50, which, upon the operation of the card entry/exit restriction unit 30 (40), gives an external signal regarding such operation (a lamp is illuminated and an alarm sound is emitted), is provided, and the operation of which is controlled by the control apparatus 12.

As described above, the card shoe apparatus of the present invention has an effect on being capable of preventing, on site, any fraudulent act such as the fraudulent insertion of cards into a card shoe apparatus, false or inappropriate dealing of cards, or the like. Thus the card shoe apparatus of the present invention is used in card games played in casinos, and effective.

REFERENCE SIGNS LIST

1 card
2 code
3 authenticity determination code
4 card shoe apparatus
5 card housing unit
6 game table
7 card guide unit
8 code reading unit
10 winning/losing determination unit
11 output unit
12 control apparatus
13 opening
14 card guide
15 sensor group
20 ultraviolet reactive sensor (UV sensor)
21 ultraviolet reactive sensor (UV sensor)
22 object detection sensor
23 object detection sensor
30 card entry/exit restriction unit
33 slot
34 lock member
35 driving unit
36 lock member
37 driving unit
40 card entry/exit restriction unit
50 error signal output unit
102 index

The invention claimed is:

1. A method of using a card shoe apparatus that includes a card housing that houses a plurality of cards, the card shoe apparatus having (i) a guide unit in which the cards are manually moved, and (ii) an opening through which the cards are manually drawn one by one, the method comprising:

reading, by a card reader controlled by a processor, information of the cards which are sequentially taken out from the card shoe apparatus to a game table;

storing, by the processor, information of the cards resulting from the reading into a memory;

judging, by the processor, whether a card game has been ended based on the stored information of the cards;

sensing, by an optical device, movement of each of the cards manually drawn from the card shoe apparatus along a dealing direction;

detecting, by the processor, an inappropriate attempt to manually draw a card from the opening to prevent an impermissible drawing after the card game ends; and outputting a signal of a result of the detection.

2. The method of claim 1, wherein the card shoe apparatus further has (iii) a lock member selectively restricting manual movement of the cards in the guide unit near the opening, the method further comprising:

based on the signal of the result of detection, controlling the lock member to restrict the manual movement of the card.

3. The method of claim 2, further comprising:

based on the information of the cards read by the card reader, controlling the lock member to restrict the manual movement of the card.

4. The method of claim 3, wherein the information of the cards includes a code on each of the cards, wherein the code indicates at least one of a number and a suit of the card.

5. The method of claim 4, further comprising comparing the code with a predetermined code stored in the memory.

6. The method of claim 3, wherein the information of the cards includes an authenticity determination code on each of the cards.

* * * * *